US005818059A

United States Patent [19]

Coyne et al.

[11] Patent Number: 5,818,059

[45] Date of Patent: Oct. 6, 1998

[54] REMOTE VACUUM COMPACTION OF COMPRESSIBLE HAZARDOUS WASTE

[75] Inventors: Martin J. Coyne, Pittsburgh; Gregory M. Fiscus, McMurray; Alfred G. Sammel, Pittsburgh, all of Pa.

[73] Assignee: United States of America as represented by the United States Department of Energy, Washington, D.C.

[21] Appl. No.: 697,846

[22] Filed: Aug. 30, 1996

[51] Int. Cl.[6] ..... G21F 5/005

[52] U.S. Cl. ..... 250/507.1; 53/512; 588/259

[58] Field of Search ..... 250/507.1; 53/512; 588/259

[56] References Cited

U.S. PATENT DOCUMENTS

| | | | |
|---|---|---|---|
| 2,335,738 | 11/1943 | Casey | 226/47 |
| 2,888,788 | 6/1959 | Gebhardt | 53/22 |
| 3,046,713 | 7/1962 | Belknap | 53/112 |
| 3,245,200 | 4/1966 | Shaw | 53/112 |
| 3,269,157 | 8/1966 | Ashley | 63/242 |
| 3,899,967 | 8/1975 | Powers | 100/269 |
| 4,062,917 | 12/1977 | Hill et al. | 264/102 |
| 4,070,962 | 1/1978 | Peterson | 100/209 |
| 4,277,688 | 7/1981 | Yamamoto et al. | 250/506 |
| 4,353,391 | 10/1982 | Belmonte et al. | 137/565 |
| 4,409,029 | 10/1983 | Larker et al. | 419/10 |
| 4,524,048 | 6/1985 | Schmidt et al. | 422/159 |
| 4,592,192 | 6/1986 | Jacob et al. | 53/512 |
| 4,771,684 | 9/1988 | Cecil et al. | 100/131 |
| 4,810,890 | 3/1989 | Blum | 250/506.1 |
| 4,863,638 | 9/1989 | Harper, III | 252/633 |
| 4,891,165 | 1/1990 | Suthanthiran | 252/633 |
| 4,907,717 | 3/1990 | Kubofeik | 220/404 |

*Primary Examiner*—Jack I. Berman
*Attorney, Agent, or Firm*—John T. Lucas; William R. Moser; Paul A. Gottlieb

[57] ABSTRACT

A system for remote vacuum compaction and containment of low-level radioactive or hazardous waste comprising a vacuum source, a sealable first flexible container, and a sealable outer flexible container for receiving one or more first flexible containers. A method for compacting low level radioactive or hazardous waste materials at the point of generation comprising the steps of sealing the waste in a first flexible container, sealing one or more first containers within an outer flexible container, breaching the integrity of the first containers, evacuating the air from the inner and outer containers, and sealing the outer container shut.

7 Claims, 4 Drawing Sheets

REMOTE VACUUM COMPACTION OF COMPRESSIBLE HAZARDOUS WASTE

FIELD OF THE INVENTION

The present invention relates to disposal of compressible hazardous waste, and more particularly to vacuum compression of radioactive, hazardous toxic and biological compressible waste for disposal.

BACKGROUND OF THE INVENTION

Typically, in nuclear applications, compressible low specific activity (LSA) waste, such as contaminated disposable paper or fabric items, are compacted in 55 gallon drums at a remote processing facility located away from where the waste is actually generated. This requires that the waste, which is collected in plastic bags and often mixed with noncompressible waste, be packed in large protective containers and transported to the processing facility. There, special equipment is used to open the bags and segregate the noncompressible waste, as necessary, and compact the waste into drums, all in a radiological environment. Typically a large room or building equipped with a high efficiency filtered exhaust system is required at the facility to store incoming and outgoing waste.

This conventional method for disposal is inefficient and poses an increased risk of hazardous exposure to the workers involved. The steps of loading the waste at the point of generation and then having to unload it at the compaction facility is time consuming and requires extra equipment. These extra handling steps also increase the risk of exposure to the workers who must handle the bags of waste. Moreover, the bags cannot be stored efficiently because of the high percentage of void space within each waste bag, mainly comprising air.

What is desired is a portable system capable of compacting the waste at the site of generation, such that further compaction at a remote facility can be eliminated. It is therefore an object of the present invention to provide a portable and relatively inexpensive vacuum compaction system for use at different locations where waste is generated.

It is a further object of the present invention to provide a system for hazardous waste compaction that reduces risk of exposure to workers involved by reducing the number of handling steps.

SUMMARY OF THE INVENTION

The present invention comprises a system and method for compacting low-level radioactive waste or hazardous waste materials, such as paper articles, gloves, and used garments, at the site of generation. The articles are initially collected in a first or inner containment bag. One or more inner containment bags are then sealed within an outer containment bag. Each inner containment bag is then punctured and air is removed from the outer bag, and hence is also removed from the inner containment bag(s) contained within, by using a vacuum pump. Once air is removed to the desired vacuum level, the vacuum source is removed and the outer containment bag is sealed shut.

In one preferred embodiment the outer containment bag comprises a self-sealing valve assembly with a detachable hollow stem on the inside of the bag for puncturing the inner containment bag(s) contained within. The vacuum source removes the air from the inner and outer containment bags via the self-sealing valve assembly. Once the vacuum source is removed, the valve automatically seals itself shut, and the seal may be reinforced using additional measures.

In another preferred embodiment, in place of a self-sealing valve, the outer containment bag comprises a sleeve. The sleeve accommodates a hollow tube or wand, attached to a vacuum source, with a sharpened end for puncturing the inner containment bags. The wand is inserted into the sleeve and temporarily sealed to the inner surface of the sleeve. The wand is then positioned inside the outer containment bag to puncture the inner bags. Once the inner bags are punctured, the vacuum source removes the air from the inner and outer containment bags through the hollow wand. Once the vacuum source is removed, the wand is withdrawn and the sleeve is sealed shut.

The first and outer containment bags may be any suitable flexible container, but preferably are constructed of polyvinyl chloride (PVC) with a thickness of 8 to 10 thousandths of an inch ("mils").

The present invention achieves several advantages, most significantly that it provides a portable and relatively inexpensive vacuum compaction system for use at different locations where waste is generated.

A further advantage of the present invention is that it reduces risk of exposure to workers involved by reducing the number of handling steps involved in disposing of the waste materials.

DETAILED DESCRIPTION OF THE PREFERRED EMBODIMENT

Figures 1, 1A:
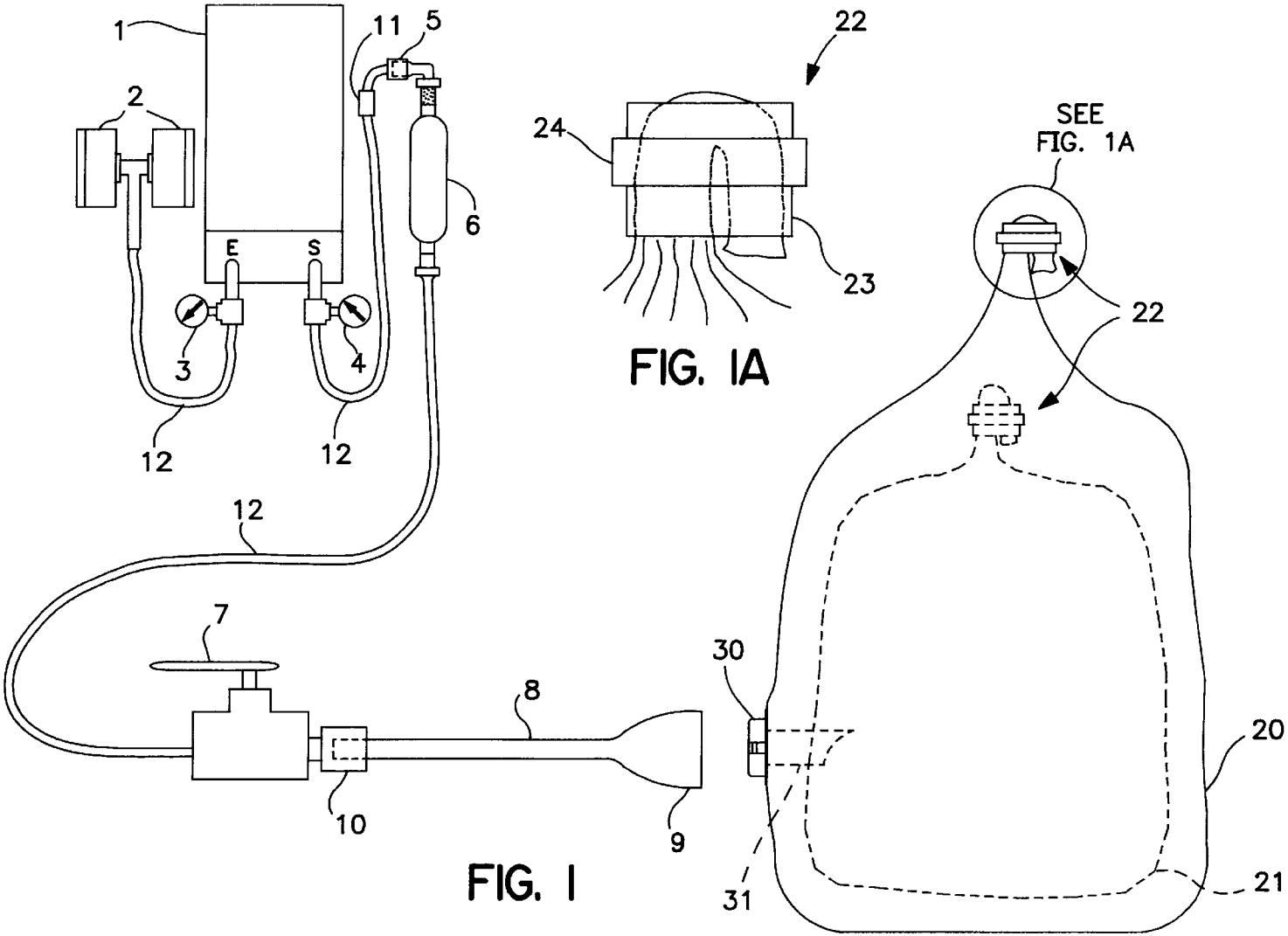
FIG. 1 depicts a vacuum compaction waste containment system of the present invention.
FIG. 1A is an isolated view of the "J"-seal used to provide a high integrity seal to waste containment bags.

Referring to FIG. 1, a preferred portable vacuum compaction system of the present invention includes a portable vacuum pump 1 capable of producing in excess of 25 inches Hg vacuum, such as a standard rotary vane vacuum pump, having a pressure gauge 3 and a vacuum gauge 4 connected to its exhaust (E) and suction (S) ports, respectively. Connected to the suction port via tubing 12 is a check valve 11, followed by quick-disconnect connection 5 connecting to vacuum filter configuration 6. Vacuum filter configuration 6 is connected via more tubing 12 to shut-off valve 7, which is connected through quick-disconnect connection 10 to a wand 8 having a flared end 9, or any other shaped end that is mechanically compatible with the valve 30. HEPA filters 2, preferably 2 cubic feet per minute (cfm) or greater capacity, are connected to the exhaust port (E) via more tubing 12.

For low-level radioactive waste, such as gloves, paper, and other fabric items, vacuum filter configuration 6 may only need to consist of a HEPA filter. However, in applications for vacuum compacting hospital biological waste materials or toxic/hazardous waste materials, it may be necessary to include additional types of filters suitable for contamination retention.

Outer flexible container 20, used to contain the waste to be compacted, is preferably a bag constructed of PVC, 8 to 10 mils thick, with a minimum tensile strength of 2,400 p.s.i. to allow for the crushing strength to compact the contents. One end of the containment bag 20 is open to receive the waste to be contained therein, and then is securely sealed to form an air-tight containment. Preferably, waste material to be compacted is sealed in a first or inner flexible container 21, also preferably a bag constructed of PVC, and then one or more inner containment bags are placed inside the outer containment bag 20. However, the compaction should still be effective and the containment secure even where waste materials are placed directly in the outer containment bag.

Referring to FIG. 1A, one preferred method for making the needed high-integrity closure of the open end of the outer containment bag 20, as well as the inner containment bag 21, is by forming a "J-seal" at the end, in which the end of the bag is bunched tightly together, twisted 360 degrees, doubled over, wrapped with strong tape 23 and secured with a band clamp 24. To ensure a high integrity seal, it may also be desirable to use contact cement or other suitable sealant on the inside surface of the portion of the containment bag that is to be formed in the J-seal. Yet other preferred methods for making the necessary high-integrity closure are disclosed below.

Figure 4:
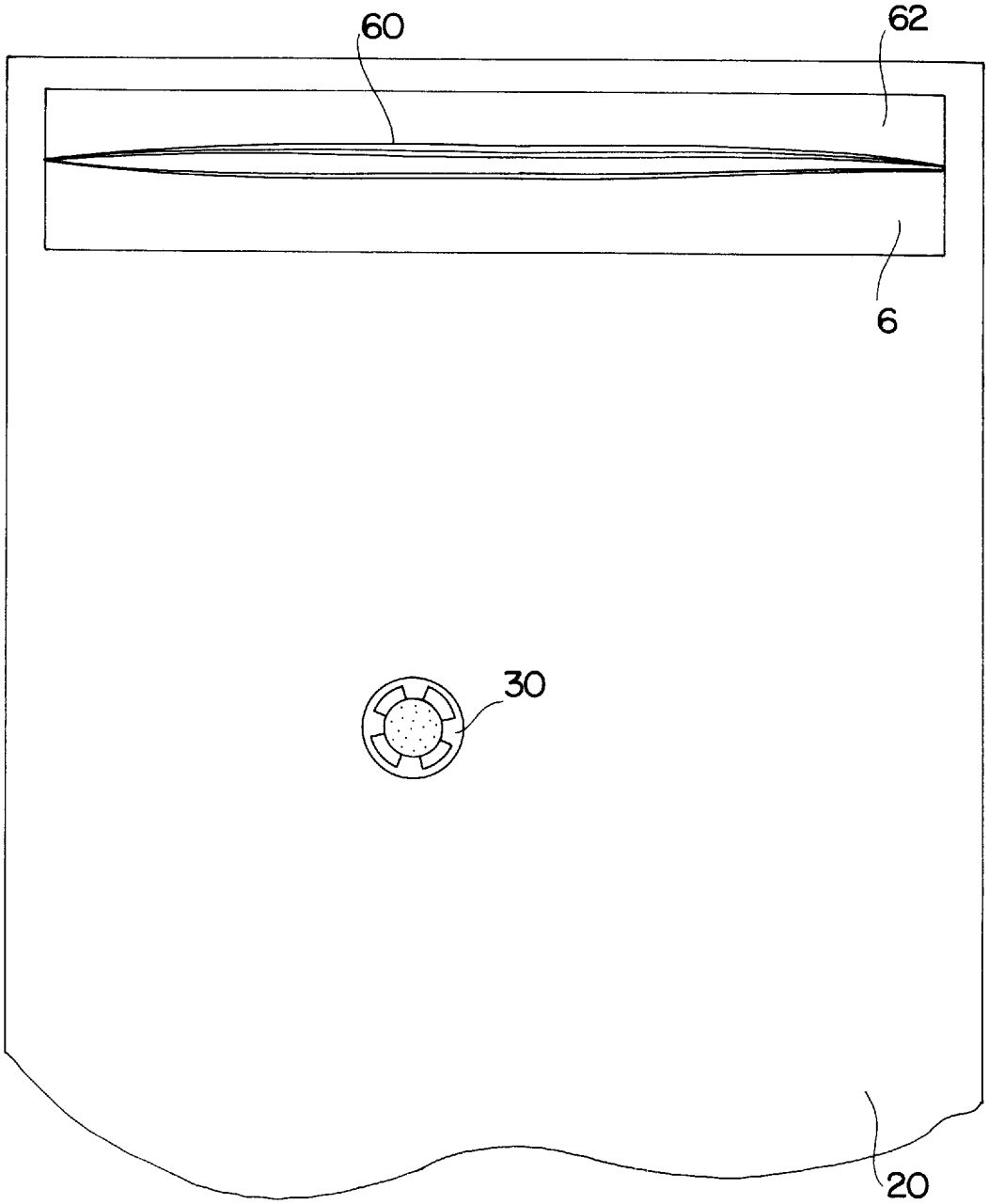
FIG. 4 depicts another preferred waste containment bag.

As in FIG. 4, in yet another preferred embodiment of outer containment bag 20, the bag is configured so that the open end has a press-sealed opening 60, such as a Ziploc™ seal. Once the press-sealed opening is press fit together, lower flap 61 is folded over the closed press-sealed opening and secured with a suitable adhesive, such as commercially available PVC cement. The top flap 62 is then folded over the bottom flap and likewise secured.

Containment bag 20 preferably includes a self-sealing valve assembly 30, such as the E. Z. Safety Seal™ self-sealing balloon valve manufactured by Dipcraft Manufacturing Company, with a valve stem 31 having a sharpened end 35. The sharpened end 35 is capable of piercing the inner bag 21 containing waste so that excess air may be withdrawn from therein. The flared end 9 of wand 8 is shaped to fit around the outside of the self-sealing valve assembly.

Figure 2A:
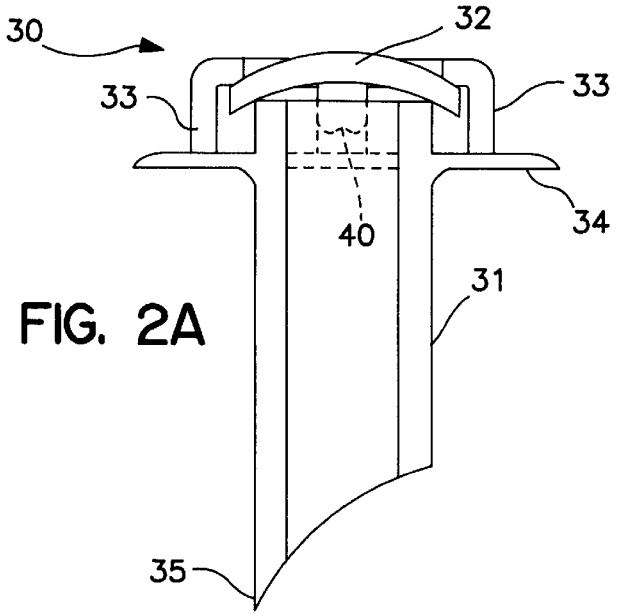
FIG. 2A is a cross-section of the side view of a preferred self-sealing valve assembly.
Figure 2B:
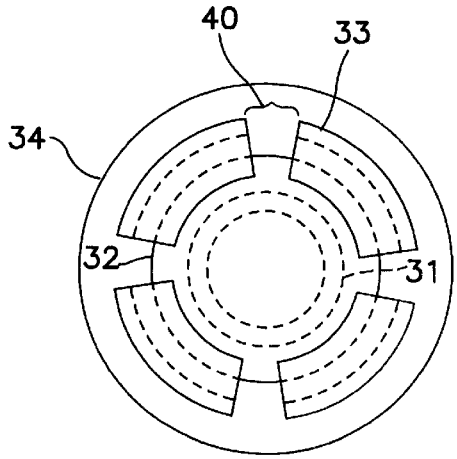
FIG. 2B is the top view of the valve assembly in FIG. 2A.

The structure of one preferred self-sealing valve assembly is depicted in FIG. 2A and 2B. The valve 30 is preferably constructed from a rigid, non-corrosive material such as hard plastic. Hollow valve stem 31 protrudes through base 34. The portion of the valve stem that protrudes from the top of the base supports balloon valve diaphragm 32, preferably made of a flexible material such as rubber, held in place by retainer flanges 33. The portion of the valve stem that protrudes from the bottom of the base has a sharpened end 35 for piercing waste bags, such as inner bag 21, contained within the outer containment bag.

Figure 2C:
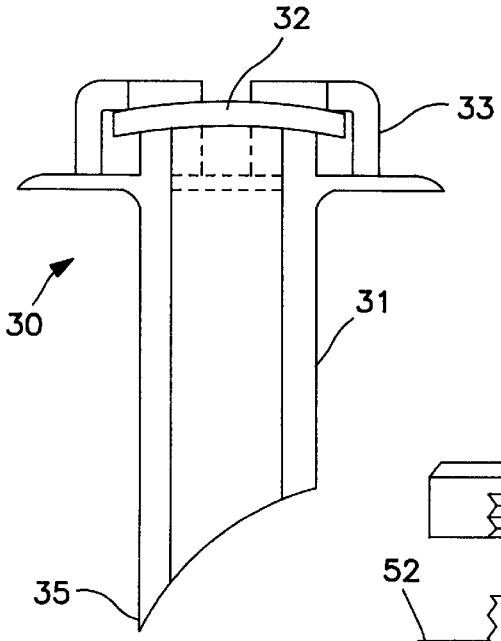
FIG. 2C is a cross-section of the side view of the self-sealing valve assembly depicted in FIG. 2A showing how the diaphragm automatically seals the contents of the containment once the outer containment bag is under vacuum.

As air is removed from the inner and outer containment bags, it travels through stem 31 underneath the balloon valve diaphragm and through gaps 40. As shown in FIG. 2C, when the vacuum pump is disengaged from the valve, the pressure differential causes the diaphragm 32 to securely cover and seal the opening of the valve stem.

The self-sealing valve assembly may be directly attached to the containment bag by using contact cement or other suitable adhesive methods to seal valve base 34 to the side of the outer containment bag. More preferably, patches made of PVC or another flexible, durable material are adhered between base 34 and the surface of the outer containment bag for better reinforcement of the valve.

Figure 3:
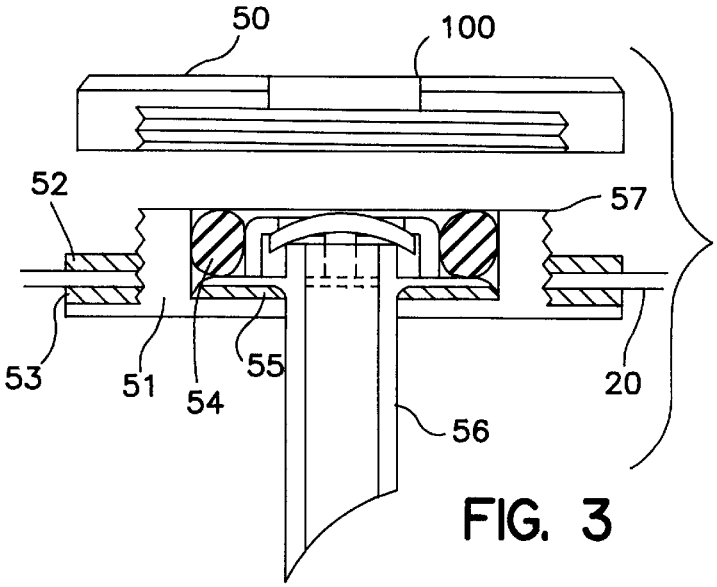
FIG. 3 is a cross-section of another preferred valve assembly.

An alternative valve assembly design is depicted in FIG. 3, wherein a self-sealing balloon valve 56, such as the one depicted in FIG. 2A, is securely sealed within a valve holder body 51, preferably made of aluminum or brass, by using contact cement 55 or some other suitable adhesive method, and surrounded by "O"-ring 54. The valve holder body is then mounted to the outer containment bag 20 and sealed thereto using upper buna-N gasket 52 and lower buna-N gasket 53. Threaded cap 50 with opening 100, preferably made of aluminum or brass, screws onto the threads 57 of the valve holder body. Once air is evacuated from the containment bags and the vacuum source is removed, preferably contact cement is applied in the opening 100 to enhance the seal.

In another preferred configuration for a valve assembly, the outer bag may be fitted with a valve, such as the one depicted in FIGS. 2 and 3, or with Roberts Valve model 40-AOF automatic check valve, heat sealed to one face of the outer bag. A hollow bag piercing fitting, such as the stem 31 in FIGS. 2 and 3 is removably attached to the bottom of the valve so that if the bags are separately manufactured and stored with the valves attached, the risk of inadvertently damaging the bags will be reduced since the sharp piercing fitting may be attached at the time of compaction.

Figure 5:
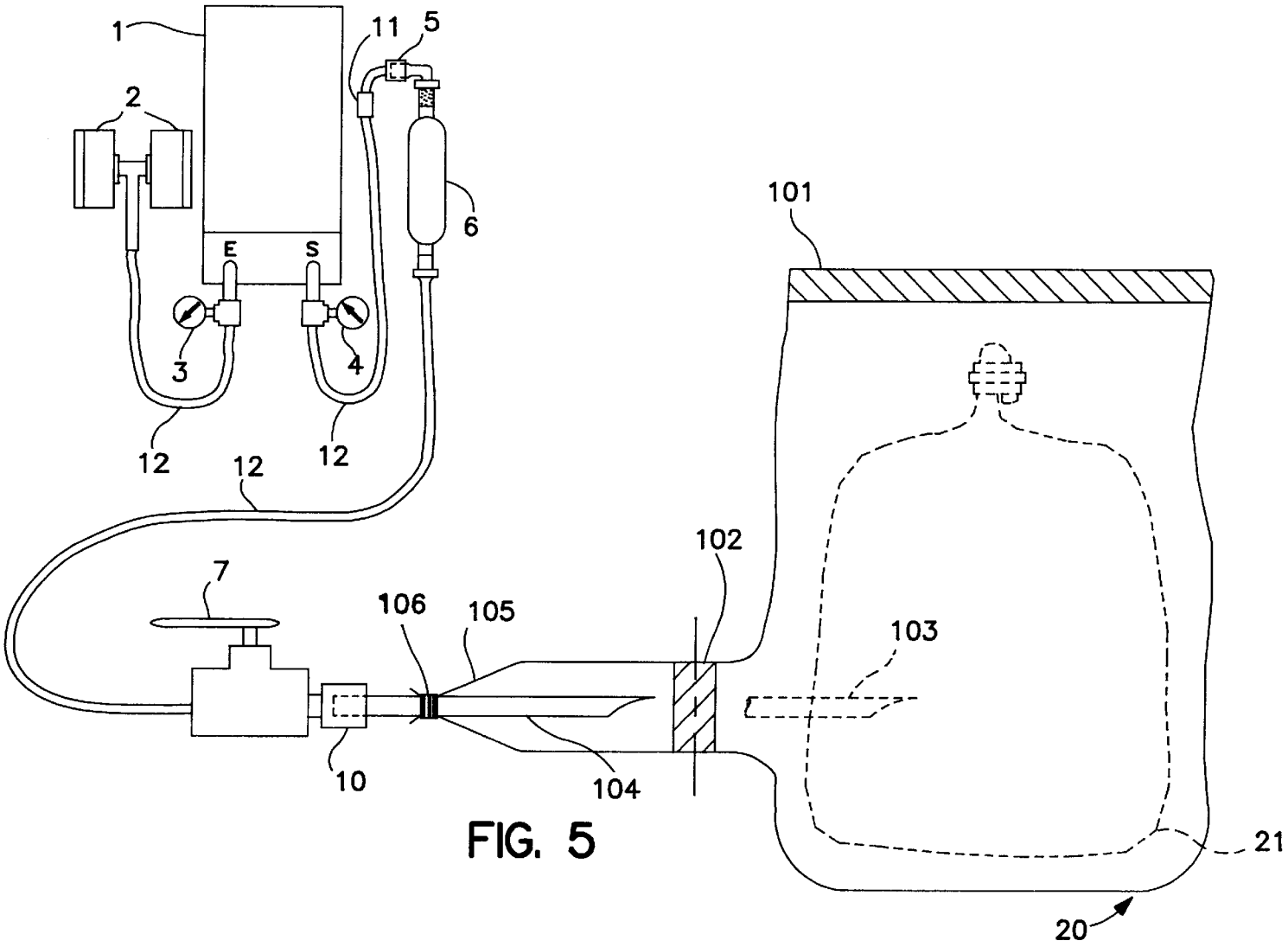
FIG. 5 depicts an alternate vacuum compaction waste containment system of the present invention, with an alternate outer containment bag construction.

Referring to FIG. 5, an alternative to using valve assemblies is to attach to the face of outer containment bag 20 a narrow, elongated sealable opening or sleeve 105. Once the inner containment bag(s) 21 are placed within the outer containment bag 20, outer containment bag 20 is heat sealed shut 101 using a heat sealing device such as the Vertrod Thermal Impulse Sealer, Model 12 H. A sharp tube or wand 104 is attached to the vacuum source via fitting 10. The wand 104 is inserted into the sleeve and temporarily sealed at point 106 using tape or other suitable adhesive. The wand is inserted into containment bag 20 to position 103 any pierces the inner containment bag(s). After vacuum is applied and air is removed from the inner and outer containment bags, wand 104 is withdrawn back to its initial position without breaking seal 106 and the sleeve opening is sealed, preferably heat sealed, at position 102. A cut is made through the seal and the remaining portion of the sleeve 105 is detached from the wand.

Referring once again to FIG. 1, in using the vacuum compaction system, waste is placed within outer containment bag 20 and the outer containment bag is then sealed by using a suitable high integrity closure. Preferably the waste is first sealed in an inner containment bag 21, and one or more inner containment bags are placed within the outer containment bag 20 and sealed therein. Having an extra layer surrounding the waste such as that afforded by the inner containment bag adds to the durability of the containment. By grasping the valve assembly 30, the pointed end 35 of the valve stem 31, which is positioned inside the outer containment bag, may be guided toward the inner containment bag 21 and pushed so as to penetrate the inner bags. Once all of the inner bags are punctured, the flared end 9 of the vacuum wand 8 is placed over valve 30. Making sure that shut-off valve 7 is closed, the vacuum pump 1 is energized, and shut-off valve 7 is opened. The void air trapped in the sealed outer and the pierced inner containment bags will be evacuated by the vacuum pump through the self-sealing valve. Evacuation is complete and total package volume is reduced when the reduced outer containment bag exhibits a visually dense appearance. Typically the vacuum gauge will read approximately 26 inches Hg. At that point the shut-off valve 7 should be closed and the suction wand 8 removed from the valve assembly. Although the diaphragm of the valve assembly seals itself to the opening of the valve stem, contact cement or other adhesive should nonetheless be immediately applied around the diaphragm to ensure the seal.

As will be apparent to those skilled in the art, many changes and substitutions can be made to the preferred embodiment herein described without departing from the spirit and scope of the present invention as defined by the appended claims.

What is claimed is:

1. A system for containing compressible radioactive or hazardous waste materials at the point of generation comprising:

(a) a vacuum source;

(b) a disposable first flexible container having a sealable open end for receiving waste; and (c) an outer flexible container having a sealable open end for receiving the first flexible container, the outer container being disposable along with the first flexible container, and comprising a sealable passageway for communicating with the vacuum source wherein the passageway provides a route for air within the outer container to exit upon applying the vacuum thereto; and (d) a means for breaching the integrity of the first flexible container after the first flexible container is sealed within the outer flexible container.

2. The system in claim 1 wherein the passageway comprises a self-sealing valve assembly.

3. The system in claim 1 wherein, the passageway comprises a self-sealing valve assembly having a stem with a sharpened end.

4. The system in claim 1 wherein the passageway comprises an elongated sleeve.

5. The system in claim 1 wherein the first flexible container comprises PVC having a thickness of between 5 and 20 mils.

6. The system in claim 1 wherein the outer flexible container comprises PVC having a thickness of between 5 and 20 mils.

7. The system in claim 1 wherein the sealable open end of the outer flexible container comprises a press seal.

* * * * *